US009691363B2

(12) United States Patent
McHugh et al.

(10) Patent No.: US 9,691,363 B2
(45) Date of Patent: Jun. 27, 2017

(54) INSTRUMENT TRIGGER SYSTEM AND METHODS OF USE

(71) Applicants: David J. McHugh, Dodge City, KS (US); Ralph L. McHugh, Sherborn, MA (US)

(72) Inventors: David J. McHugh, Dodge City, KS (US); Ralph L. McHugh, Sherborn, MA (US)

( * ) Notice: Subject to any disclaimer, the term of this patent is extended or adjusted under 35 U.S.C. 154(b) by 0 days.

(21) Appl. No.: 14/802,907

(22) Filed: Jul. 17, 2015

(65) Prior Publication Data

US 2017/0018261 A1 Jan. 19, 2017

(51) Int. Cl.

| | |
|---|---|
| ***G10D 3/00*** | (2006.01) |
| ***G10D 3/02*** | (2006.01) |
| ***G10D 15/00*** | (2006.01) |
| ***G10D 1/00*** | (2006.01) |
| ***G10D 1/08*** | (2006.01) |
| ***G10H 1/00*** | (2006.01) |
| ***G10H 1/02*** | (2006.01) |
| ***G10H 1/055*** | (2006.01) |
| ***G10H 1/14*** | (2006.01) |
| ***G10H 1/32*** | (2006.01) |
| ***G10H 3/00*** | (2006.01) |
| ***G10H 3/18*** | (2006.01) |

(52) U.S. Cl.

CPC ..... *G10D 3/00* (2013.01); *G10D 1/00* (2013.01); *G10D 1/08* (2013.01); *G10D 1/085* (2013.01); *G10D 3/02* (2013.01); *G10D 15/00* (2013.01); *G10H 1/00* (2013.01); *G10H 1/02* (2013.01); *G10H 1/055* (2013.01); *G10H 1/14* (2013.01); *G10H 1/32* (2013.01); *G10H 3/00* (2013.01); *G10H 3/18* (2013.01)

(58) Field of Classification Search

CPC G10D 3/00; G10D 15/00; G10D 3/02; G10D 1/00; G10D 1/08; G10D 1/085; G10H 1/00; G10H 1/32; G10H 1/14; G10H 1/02; G10H 1/055; G10H 3/00; G10H 3/18

USPC ..... 84/723, 626, 632, 710, 726, 743

See application file for complete search history.

(56) References Cited

U.S. PATENT DOCUMENTS 3,296,916 A * 1/1967 Palmer ..... G10H 3/18 455/66.1
3,375,747 A * 4/1968 Posey ..... G10D 3/00 84/267
4,581,972 A * 4/1986 Hoshino ..... G10D 13/024 84/411 P (Continued)

*Primary Examiner* — David Warren
*Assistant Examiner* — Christina Schreiber
(74) *Attorney, Agent, or Firm* — Wolf, Greefield & Sacks, P.C.

(57) ABSTRACT

Aspects disclosed herein relate to an instrument trigger system and methods of using such a system. In one aspect, the instrument trigger system includes a plurality of triggers, where each trigger is vibrationally isolated from the other triggers and/or from vibrations of the instrument to prevent unintended actuation of a trigger. In another aspect, the instrument trigger system includes one or more triggers that are easily accessible by a musician such that trigger actuation can be naturally integrated into the musician's play. In some embodiments, a sound module is integrated with the instrument trigger system.

28 Claims, 6 Drawing Sheets

(56) References Cited

U.S. PATENT DOCUMENTS 5,105,711 A * 4/1992 Barnard ..... G10H 3/18 84/737
5,403,972 A * 4/1995 Valentine, Sr. ..... G10H 3/14 84/730
5,614,688 A * 3/1997 Donnell ..... G10H 3/181 84/743
5,627,336 A * 5/1997 Stevens ..... G10H 1/0555 84/746
5,900,573 A * 5/1999 Barnes ..... G10D 15/00 84/171
6,369,304 B1 * 4/2002 Tucker ..... G10D 3/00 84/267
6,441,293 B1 * 8/2002 LaBarbera ..... G10H 3/146 84/290
6,696,632 B2 * 2/2004 Minakuchi ..... G10H 1/32 84/290
6,723,908 B2 * 4/2004 Chapman ..... G10D 1/085 84/291
6,800,797 B2 * 10/2004 Steiger, III ..... G10D 1/085 84/267
7,015,390 B1 * 3/2006 Rogers ..... G10H 1/32 84/1
7,247,789 B2 * 7/2007 Fishman ..... G10H 1/32 84/723
7,408,109 B1 * 8/2008 Freitas ..... G10H 3/12 84/687
7,541,536 B2 * 6/2009 Daniel ..... G10H 1/053 84/626
8,148,624 B2 * 4/2012 Raisanen ..... G10H 1/055 84/615
8,614,383 B1 * 12/2013 Palais ..... G10D 1/08 84/294
8,907,200 B2 * 12/2014 Bekerman ..... G10H 1/32 84/727
8,907,201 B2 * 12/2014 Jensen ..... G10D 15/00 84/743
9,396,707 B1 * 7/2016 Clark ..... G10D 1/08
2003/0131721 A1 * 7/2003 Minakuchi ..... G10H 1/32 84/726
2004/0003703 A1 * 1/2004 Chapman ..... G10D 1/085 84/453
2007/0028752 A1 * 2/2007 McGrew ..... G10H 3/143 84/726
2013/0263721 A1 * 10/2013 Shavit ..... G10H 1/055 84/626
2013/0276621 A1 * 10/2013 Bekerman ..... G10H 1/32 84/726
2015/0332660 A1 * 11/2015 Adams ..... G10H 1/0066 84/645
2017/0018261 A1 * 1/2017 McHugh ..... G10D 15/00

* cited by examiner

INSTRUMENT TRIGGER SYSTEM AND METHODS OF USE

FIELD

Aspects of the disclosure relate to instrument trigger systems and to methods of using such instrument trigger systems.

BACKGROUND

Musicians use various percussive techniques on instruments that are not traditionally classified as percussion instruments, including string instruments such as the guitar, ukulele, banjo, mandolin, cuatro, lute, cello, viola, violin, double bass, etc. Some percussive techniques involve striking the instrument body directly with the hand or with a bow.

SUMMARY

According to one aspect, a trigger system for a string instrument is provided. The system includes a first plate that is attachable to an instrument and a first transducer that is attachable to the first plate. The first transducer is configured to output an electrical signal in response to physical vibration of the first plate. The first plate vibrationally isolates the first transducer from vibrations of the instrument.

According to another aspect, a kit for a trigger system for a string instrument is provided. The kit includes a first plate that is attachable to an instrument, a sound module and a first transducer that is attachable to the first plate. The first transducer is configured to output an electrical signal to the sound module in response to physical vibration of the first plate. The first plate vibrationally isolates the first transducer from vibrations of the instrument.

According to yet another aspect, a method of using a trigger system for a string instrument is provided. The method includes providing a first transducer that is attached to a first plate, where the first plate is attached to an instrument. The method also includes striking the first plate to vibrate the first plate, where the striking of the first plate actuates the first transducer to output an electrical signal.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
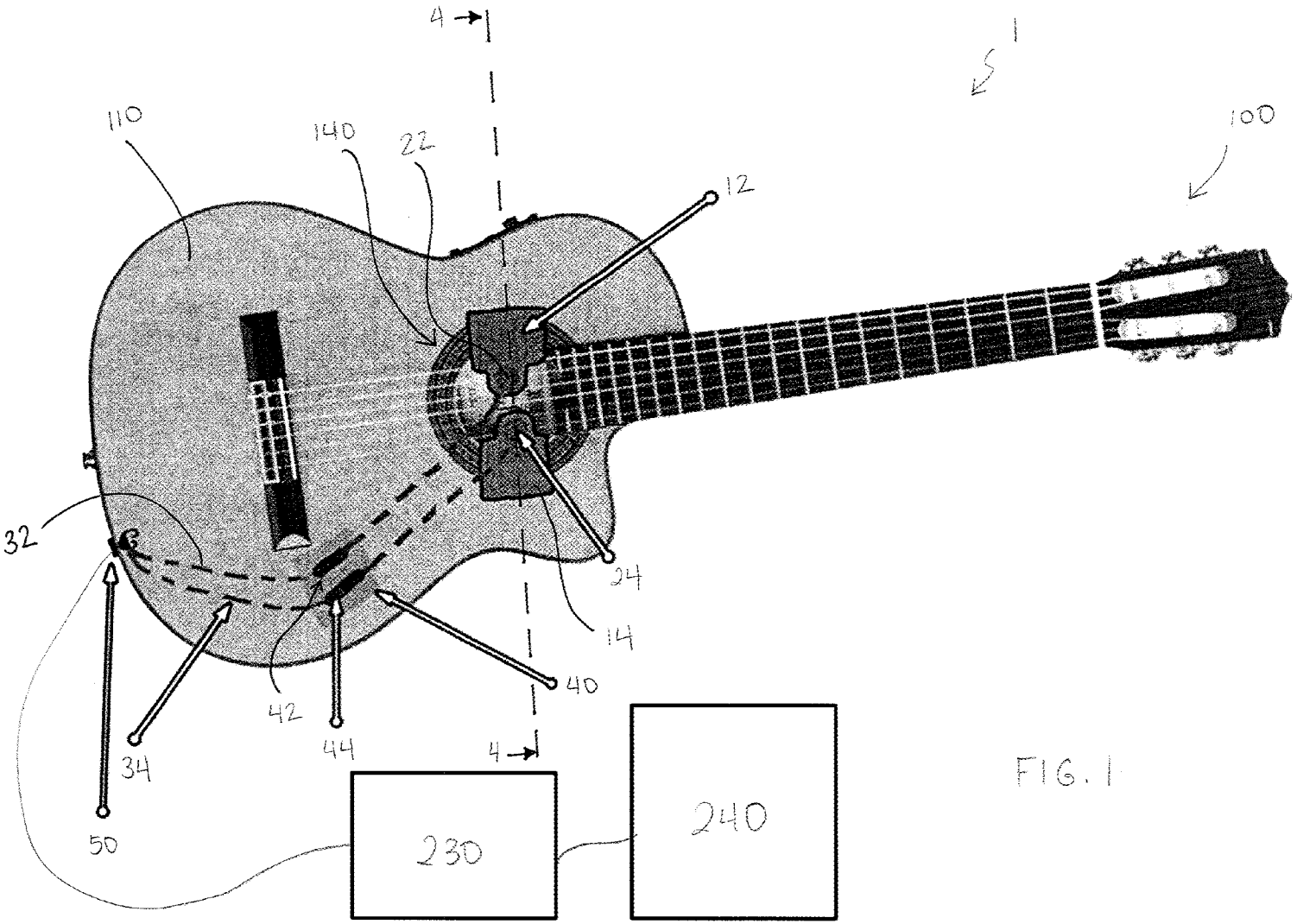
FIG. 1 is a schematic of an instrument trigger system according to one embodiment.

Aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Aspects of the present disclosure relate to instrument trigger systems and to methods of using such systems. While aspects of the instrument trigger system may be discussed in relation to a guitar, it should be appreciated that the instrument trigger system may be used with other instruments as well, such as a ukulele, banjo, mandolin, cuatro, lute, cello, viola, violin, double bass, or other stringed instruments that are hand-played, strummed or plucked.

The inventors have appreciated that string instruments may be enhanced by adding an easily accessible trigger system that musicians can use to elicit different actions such as generating electronic signals and outputting them to, for example, a signal receiving device such as a sound module, a looping machine, and/or a visual display such as a light display or screen. The inventors have also appreciated that it may be desirable to provide a trigger system in which each trigger is isolated from other triggers and/or from vibrations of the instrument (e.g., from the instrument body or from the strings) to prevent unintended actuation of a trigger.

In some embodiments, a trigger of the instrument trigger system comprises a device that outputs electrical signals in response to a physical vibration, such as a transducer that converts physical vibration into electrical signals. For example, the transducer may be a piezoelectric transducer or a force sensitive resistor transducer. In some embodiments, the transducer is a drum trigger. The inventors have appreciated that a transducer may be inadvertently actuated by a vibration that was not intended to actuate the transducer. For example, two transducers attached directly to a single, continuous piece of material may both be actuated when any portion of the continuous piece of material is struck or otherwise vibrated. As such, two transducers attached directly to, for example, the body of a guitar, may be simultaneously actuated when only intending to actuate one of the transducers, as vibrations that actuate one transducer can actuate the second transducer, resulting in "cross-talk" between transducers. Further, if any portion of the guitar body is struck or tapped, purposely or accidentally, both transducers may be actuated.

As used herein, the term "attached" includes, but is not limited to, arrangements in which items are directly attached to one another. Additionally, a first item can be considered to be "attached" to a second item by being attached to the second item via an intermediate component or components.

The inventors have appreciated that it may be desirable eliminate such "cross-talk" or other unwanted actuation and to have an arrangement where a transducer is actuated only when a localized area (e.g., near or around the transducer) is struck or otherwise vibrated. The inventors have also appreciated that, in some embodiments, it may be desirable to have two or more transducers that can be independently actuatable such that each transducer may elicit a different action. As an illustrative example, a first transducer may send an electric signal to a sound module to output a first type of sound, such as a bass drum, and a second transducer may send an electric signal to a sound module (the same or a different sound module) to output a second type of sound, such as a snare drum. As another illustrative example, the first transducer may send an electric signal to the "A" pedal of a looping machine and the second transducer may send an electric signal to the "B" pedal of the looping machine.

In some embodiments, isolating a transducer from unwanted vibrations may be accomplished by attaching the transducer to an isolation component that is attached to the instrument, rather than attaching the transducer directly to the instrument itself. The isolation component is a component that vibrationally isolates one or more transducers from vibrations external to the isolation component. At the same time, however, the isolation component itself can be vibrated, e.g., by striking the isolating component directly (rather than striking the instrument to which the isolating component is attached to), and vibration of the isolation component actuates the one or more transducers associated with (e.g., attached to) the isolation component.

The isolation component may achieve such a result in different ways (or in a combination of ways). In some embodiments, the isolation component is a component that is separate and distinct from the instrument body (i.e., the isolation component and the instrument body are not a single, monolithic component.) Without wishing to be bound by theory, vibrations may have difficulty propagating from one component to a second distinct component even when the two components are in direct contact with one another. This may be because of a discontinuity when transitioning from the first component to the second component. In some embodiments, the isolation component may be formed from a material that resists propagation of vibration from a component in direct contact with it, but will vibrate when struck directly. In some embodiments, the isolation component is formed from a material with a higher modulus of elasticity and/or a higher density than that of the instrument body to which it is attached. For example, the instrument body is made of wood and at least a portion of the isolation component is made of metal. In some embodiments, the isolation component may be sized and shaped in such a way to give rise to the properties described above. For example, the isolation component may have a certain thickness, shape, may have specifically placed cutouts, etc. that result in these properties. In some embodiments, the isolation component may include a vibration damping arrangement at the interface between the isolation component and the instrument. The vibration damping arrangement at the interface may stop vibrations from propagating from the instrument to the isolation component, but may permit the isolation component itself to vibrate, e.g., when the isolation component is struck directly. The damping arrangement may be passive (e.g. with springs, foam, etc.) or active.

In some embodiments, an isolation component includes a plate. In such embodiments, the transducer is attached to a plate, which in turn is attached to the instrument. In some embodiments, as will be described below, the plate is attached to an intermediate component that is attached to the instrument, rather than attaching the plate directly to the instrument itself, such that the plate is indirectly attached to the instrument. In some embodiments, the plate isolates the transducer from vibrations of the instrument body, and thus striking the instrument itself does not actuate the transducer. Instead, only the striking of the plate itself actuates the transducer. Thus, unlike in an acoustic pickup arrangement, where the pickup transducer is attached to the instrument in such a way so as to sense the vibrations of the instrument body and/or the strings of the instrument and output an electrical signal in response, here, the isolation component vibrationally isolates the transducer from the instrument such that vibrations of the instrument, such as from the instrument body or the strings, fail to actuate the transducer. Instead, only vibrations of the isolation component itself, produced by striking the isolation component directly, will actuate the transducer.

In some embodiments, in addition to a plate, the isolation component includes a vibration absorbing material that may help to absorb vibrations of the instrument body. The vibration absorbing material may be a soft and spongy material such as felt, foam, thick tape such as foam tape, etc. The vibration absorbing material may be positioned between the instrument body and the plate such that the plate is indirectly attached to the instrument body. In one embodiment, double-sided foam tape attaches a plate to the instrument body, and the double-sided tape is a thick foam tape, e.g., ⅛ inches thick. As such, the plate is indirectly attached to the instrument body. In addition, in such an embodiment, the isolation component comprises both the plate and the vibration absorbing material (e.g., the foam tape) together. In other embodiments, other felt, foam or foam tape thicknesses may be used for the vibration absorbing material, e.g., ¼ inches, 1/16 inches, or any thickness in-between.

In some embodiments, the attachment area between the isolation component and the instrument body may be smaller than the surface area of the isolation component facing and directly overlying the instrument body. For example, in an embodiment where a plate is attached to the instrument body, double-sided tape may adhere the borders of the plate, or only two of the opposing ends of the plate border, to the instrument, while the other areas of the plate are free of tape. As such, the attachment area between the isolation component and the instrument body is smaller than the area of the plate facing and directly overlying the instrument body. The area of the plate that remains unattached is spaced apart from the instrument body. Open space between the plate and the instrument body may help to prevent vibrations of the instrument body from propagating to the plate.

In other embodiments, the plate may be attached to the instrument body by other arrangements, e.g. hook and loop type fasteners, mechanical attachment, or via any other suitable arrangement.

In embodiments with two transducers, the second transducer may be attached to a second plate that is separate and distinct from the first plate of the first transducer, such that vibration of the first plate actuates only the first transducer to output an electrical signal and does not actuate the second transducer. In other words, striking the first plate actuates only the first transducer such that the second transducer remains unactuated (i.e., striking the first plate fails to actuate the second transducer). Similarly, vibration of the second plate actuates only the second transducer to output an electrical signal and fails to actuate the first transducer. In other words, striking the second plate actuates only the second transducer such that the first transducer remains unactuated.

In embodiments with more than two transducers, each transducer may have its own associated plate that is separate and distinct from the plates of the other transducers. In other embodiments, two or more transducers may be attached to the same plate such that the transducers are isolated from the instrument but not from one another. In such an arrangement, striking the plate may actuate the two or more transducers simultaneously. Such an arrangement may be used to produce two or more sounds or actions upon striking of a single plate. For example, striking a plate that has two attached transducers may actuate the first transducer to output a bass drum sound and may actuate the second transducer to output a claves sound. The system may, in some embodiments, further include a second group of two or more transducers on a second plate such that the second group of transducers is isolated from the instrument and also isolated from the first group of transducers.

In some embodiments, the transducers may require a minimum threshold vibration magnitude before generating and outputting an electrical signal. In some embodiments, the minimum threshold of one or more transducers may be raised to further decrease unintended actuation of the transducer. In some embodiments, the user may raise or lower the minimum threshold of each transducer to tailor the system to the user's individual preferences and purposes.

Turning to the figures, FIG. 1 depicts an embodiment of an instrument trigger system 1 that is used with a guitar 100. A guitar is provided in the figures as a non-limiting, illustrative example. As discussed previously, it should be appreciated that the instrument trigger system may be used with other instruments besides a guitar, such as a ukulele, banjo, mandolin, cuatro, lute, cello, viola, violin, double bass, or other stringed instruments that are hand-played, strummed or plucked. In this embodiment, the instrument trigger system 1 includes a first transducer 22 that is attached to a first plate 12, which serves as part of an isolation component.

Figure 2:
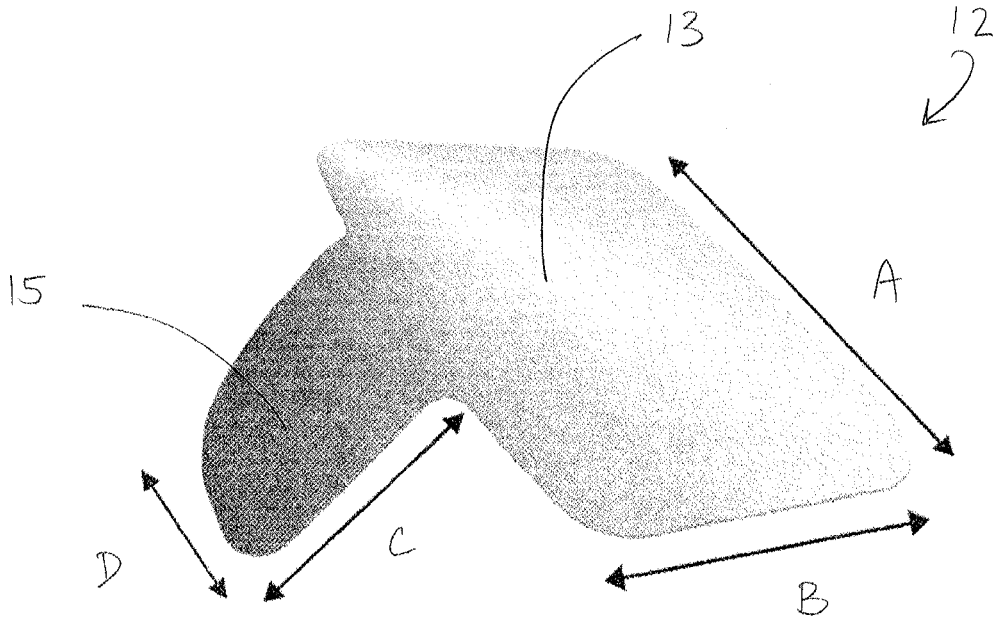
FIG. 2 is a perspective view of a plate according to one embodiment.
Figure 3:
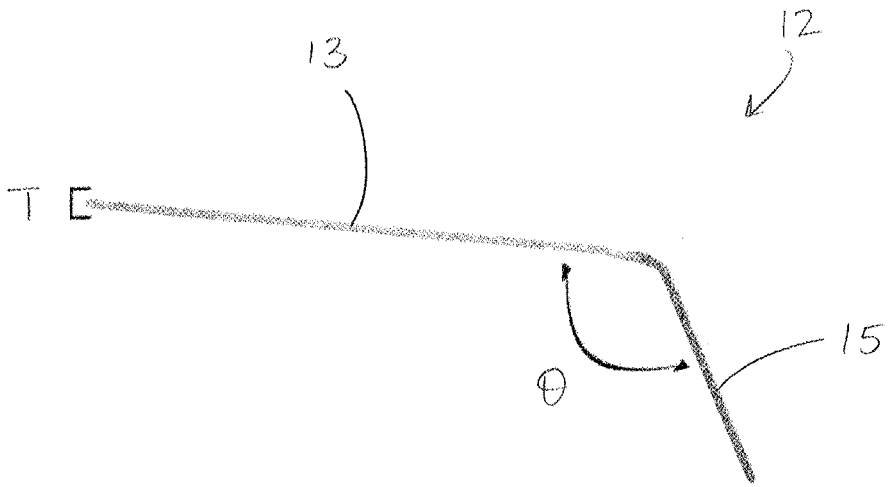
FIG. 3 is a side view of the plate shown in FIG. 2.
Figure 4:
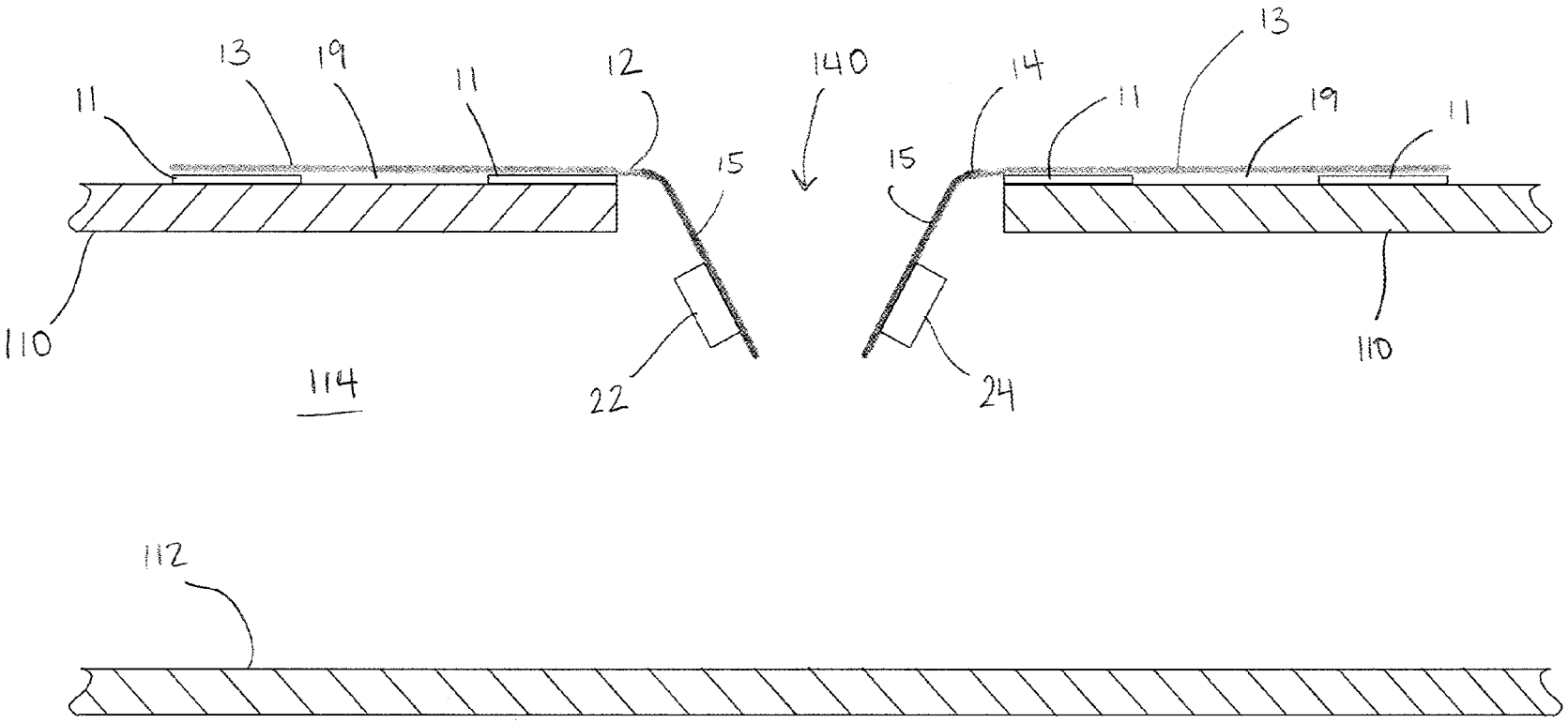
FIG. 4 is a schematic of a cross-section taken along the line 4-4 in FIG. 1.

A perspective view of the plate 12 is shown in FIG. 2, and a side view of the plate is shown in FIG. 3. The dimensions and geometry of the plate will be discussed in a later section. FIG. 4 is a schematic cross-section taken along the line 4-4 in FIG. 1. As seen in FIG. 4, the first plate 12 is attached to the guitar body 110, and a transducer 22 is attached to the first plate 12. In some embodiments, a second plate 14 is also attached to the guitar body 110, and a second transducer 24 is attached to the second plate 14. In the embodiment shown in FIG. 4, the transducers 22, 24 are attached to the underside of the plates 12, 14. It should be appreciated, however, that transducers may be alternatively attached to the topside of the plates. In this embodiment, the plates 12, 14 are bent inwardly into the sound hole 140 of the guitar and extend into the space 114 inside the hollow body of the instrument. The transducers are each attached to a bent section 15 of the plates. The plates 12, 14 are arranged so that neither the plates 12, 14 nor the transducers 22, 24 contact the inside surface 112 of the instrument body. As seen in FIG. 4, a vibration absorbing material 11 is positioned between the instrument body 110 and the first plate 12. In this embodiment, the vibration absorbing material 11 is a double-sided foam tape which serves to attach the plate 12 to the instrument body 110. However, it should be appreciated that other arrangements are possible as well. For example, the vibration absorbing material may be foam, felt, or other suitable soft, spongy material that is glued or taped to the instrument body and to the plate.

The first plate 12 may serve to vibrationally isolate the first transducer 22 from vibrations of the instrument body 110 to prevent the first transducer 22 from being actuated when the instrument 100 is bumped or struck. As discussed previously, the vibration absorbing material 11 may also serve to vibrationally isolate the first transducer 22 from the vibrations of the instrument body 110. Furthermore, in some embodiments, such as that shown in FIG. 4, the area of attachment between the first plate 12 and the instrument body 110 is less than the area of the plate that faces and directly overlies the instrument body. In the FIG. 4 embodiment, there is a strip of vibration absorbing material 11 at a left portion of the plate 12 and strip of vibration absorbing material 11 at a right portion of the plate, the two strips of material being spaced from one another to form a gap 19. The presence of this gap 19 between the first plate 12 and the instrument body 110 may help to decrease vibrations of the instrument body 110 from propagating to the plate 12. Together the plate 12 and vibration absorbing material 11 comprise an isolation component that vibrationally isolates the first transducer 22 from the instrument body 110.

In this embodiment, the second plate 14 is similarly mounted to the instrument body 110 such that the second plate 14 and vibration absorbing material 11 comprise an isolation component that vibrationally isolates the second transducer 24 from the instrument body 110.

With the two transducers 22, 24 attached to separate and distinct isolation components, the transducers are vibrationally isolated from one another. As such, when the first plate 12 is struck, the first transducer 22 is actuated and the second transducer 24 remains unactuated. When the second plate 14 is struck, the second transducer 24 is actuated and the first transducer 22 remains unactuated. Further, when the instrument 100 itself is struck, bumped or otherwise vibrated, both of the transducers 22, 24 remain unactuated.

In other embodiments, the vibration absorbing material is omitted.

When the first transducer 22 is actuated, the first transducer 22 outputs an electrical signal through a first cable 32 to an output jack 50. The output jack 50 may connect to any suitable signal receiving device 230, such as, for example, a sound module, a looping machine or a light display. In some embodiments, the sound module is a percussion synthesizer. Similarly, when the second transducer 24 is actuated, the transducer 24 outputs an electrical signal through a second cable 34 to the output jack 50. The jack may be a single channel, stereo, or multi-channel jack.

It should be appreciated that any suitable number of transducers and isolation components may be used. In some embodiments, the instrument trigger system includes only a single transducer, and the system may include only a single plate to which the transducer is attached. In some embodiments, the instrument trigger system includes 2, 3, 4, 5, 6, 7 or 8 transducers, and the system may include a separate isolation component for each transducer. In some embodiments, two or more transducers may be attached to a single isolation component.

The inventors have appreciated that it may be desirable to allow the one or more triggers to be easily accessible by the musician such that trigger actuation can be naturally integrated into the musician's play. In some embodiments, a transducer is attached to an isolation component, which in turn is attached to the instrument in a location that is near the area of the instrument where at least one of the musician's hands is typically near during standard play, e.g., when the musician's strumming/plucking/fingerpicking/picking hand is at "first position". For example, with an acoustic or classical guitar, the musician's hand is typically positioned near the sound hole of the guitar. An isolation component to which a transducer is attached is thus positioned close to the sound hole of the guitar such that the musician need not move the hand a far distance away from its usual position. As an illustrative example, with the isolation component located above the sound hole, the user may strike the isolation component and move the hand downwardly toward the strings to strum or fingerpick the strings in one fluid movement. The user may also stretch the hand such that the thumb reaches the isolation component while the rest of the fingers remain close to or at their usual positions. As another illustrative example, with the isolation component located below the sound hole, the user may strum or fingerpick the strings and then move the hand downwardly to strike the isolation component. The user may also stretch the hand such that the pinky finger and/or ring finger reaches the isolation component. It should be appreciated that the user may strike the isolation component(s) in any suitable way and may also integrate such an action into the playing of the instrument in any suitable way. The user may strike the isolation component directly by hand or with an intermediate object, such as, for example, a pick or a bow.

In some embodiments, a first isolation component is located above the sound hole and a second isolation component is located below the sound hole. In some embodiments, one or more isolation components may be located near the sound hole, e.g., at least a portion of the isolation component is located within 4 inches, 3 inches, 2 inches or 1 inch from the sound hole, adjacent to the sound hole, or at (i.e., extending at least partially across and/or into) the sound hole. For example, as seen in FIG. 1, the instrument trigger system 1 includes a first plate 12 near the sound hole 140, where the first plate 12 serves as an isolation component. A portion of the first plate 12 is located adjacent to and above the sound hole 140 and the other portion of the first plate 12 that extends partially across the sound hole 140 is located at the sound hole 140. The instrument trigger system 1 also includes a second plate 14 near the sound hole 140, where the second plate 14 also serves as an isolation component. A portion of the second plate 14 is located adjacent to and below the sound hole 140 and the other portion of the second plate 14 that extends partially across the sound hole 140 is located at the sound hole 140.

As another example, during standard play with a violin, viola, cello and double bass, during the end of a full up bow stroke, in general, the musician's bow hand is positioned near the region of the instrument between the bridge and the lower portion of the fingerboard. When performing pizzicato, the musician's hand is generally also positioned near the region of the instrument between the bridge and the lower portion of the fingerboard. Similarly, with an electric guitar, the musician's hand is typically positioned near the region of the instrument between the bridge and the lower portion of the fingerboard. In each of these examples, the isolation component to which the transducer is attached is located near the region of the instrument between the bridge and the lower portion of the fingerboard such that the isolation component can be conveniently reached by the musician's hand.

In some embodiments, the one or more isolation components may be located near the region of the instrument between the bridge and the lower portion of the fingerboard, e.g., at least a portion of the isolation component is located within 4 inches, 3 inches, 2 inches or 1 inch from the region, adjacent to the region, or at (i.e., extending at least partially across) the region.

In some embodiments, at least a portion of an isolation component extends partially across a sound hole of the instrument. In some embodiments, one end of the isolation component is attached to the instrument, and the other end of the isolation component extends partially across the sound hole. In some embodiments, the isolation component may extend entirely across a sound hole of an instrument. In some embodiments, the transducer is attached to the portion of the isolation component that extends at least partially across the sound hole.

In one illustrative embodiment, as seen in FIG. 1, one end of first plate 12 is attached to the instrument 100 and the other end extends partially across the sound hole 140 of the instrument. The first transducer 22 is attached to the portion of the plate 12 that extends partially across the sound hole.

In some embodiments, to avoid interference with the strings and/or with other isolation components, the portion of the isolation component that extends at least partially across the sound hole of the instrument may have a decreased width (gradual or step-wise) as compared to the rest of the isolation component. In one illustrative example, seen in FIG. 2, plate 12, which serves as an isolation component, includes a first section 13 and a second section 15. As seen in FIG. 2, the second section 15 of the plate may extend from first section 13 by a length C and may have a different width D as compared to the width A of the first section 13 such that the second section 15 forms a protruding portion, e.g., a tongue. In some embodiments, the width D of the second section 15 of the plate may be less than the width A of the first section 13. The extension length C of the second section 15 of the plate may be more than, less than, or equal to the length B of the first section 13. In some embodiments, the width A may be 2 to 5 inches, 3 to 4 inches or 3.5 inches. In some embodiments, the length B may be 1 to 3 inches, 2 to 3 inches, or 2.625 inches. In some embodiments, the length C may be 0.25 to 2.5 inches, 0.5 to 2 inches, 1 to 2 inches, or 1.625 inches. In some embodiments, the width D may be 0.5 to 2.25 inches, 1 to 2 inches, 1.25 to 1.75 inches, or 1.5 inches.

The plate may have a uniform width and may attach to the instrument 100 without interfering with the strings. In some embodiments, the plate is a long and narrow strip of material with a uniform width. For example, the plate may have a thickness of 0.5 to 1 inch and a length of 2 to 6 inches. In one embodiment, the instrument trigger system includes multiple plates of this long and narrow geometry, i.e., where the length of the plate is greater than the width. The plates may be arranged on the instrument such that they extend length-wise outwardly away from the sound hole. For example, in one embodiment, the plates extend radially outwardly away from the sound hole. In other embodiments, the plate extend outwardly from the sound hole, but not all plates need extend radially outwardly, e.g., some plates may extend out from the sound hole but may be angled such that its length-wise direction is not aligned with a diameter of the sound hole. In one embodiment, a first group of long and narrow plates extending from the sound hole are positioned above the sound hole and second group of long and narrow plates extending from the sound hole are positioned below the sound hole. Each group of plates may include 2, 3 or 4 plates.

In some embodiments, to avoid interference with the strings, the portion of the plate that extends at least partially across the sound hole of the instrument may be bent inwardly into the sound hole.

In some embodiments, as seen in FIGS. 3 and 4, the plate may be bent. In some embodiments, as seen in FIG. 3, the plate may be bent at an angle θ may be 30° to 150°, 50° to 140°, 70° to 130°, 80° to 130° or 100° to 130°, 110° to 120°, 113° to 117° or 115°.

Figure 5:
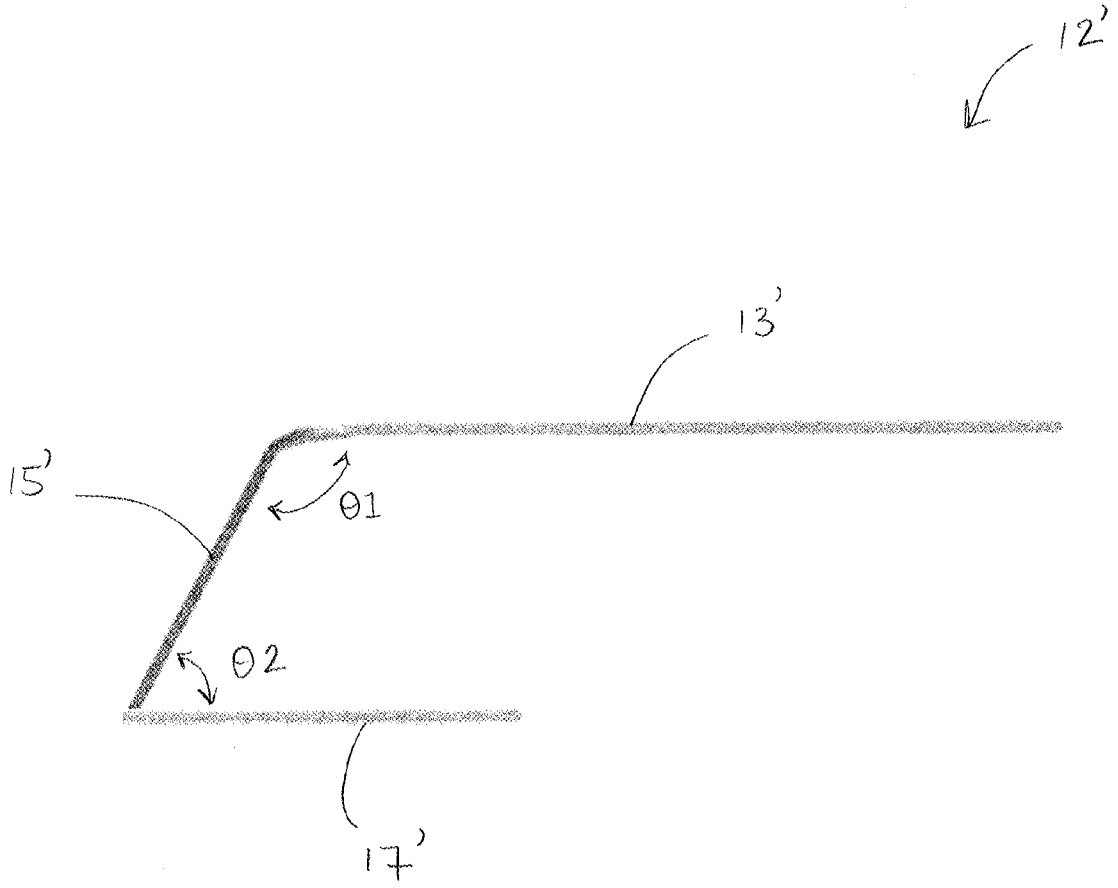
FIG. 5 is a side view of a plate with two bends, according to one embodiment.
Figure 6:
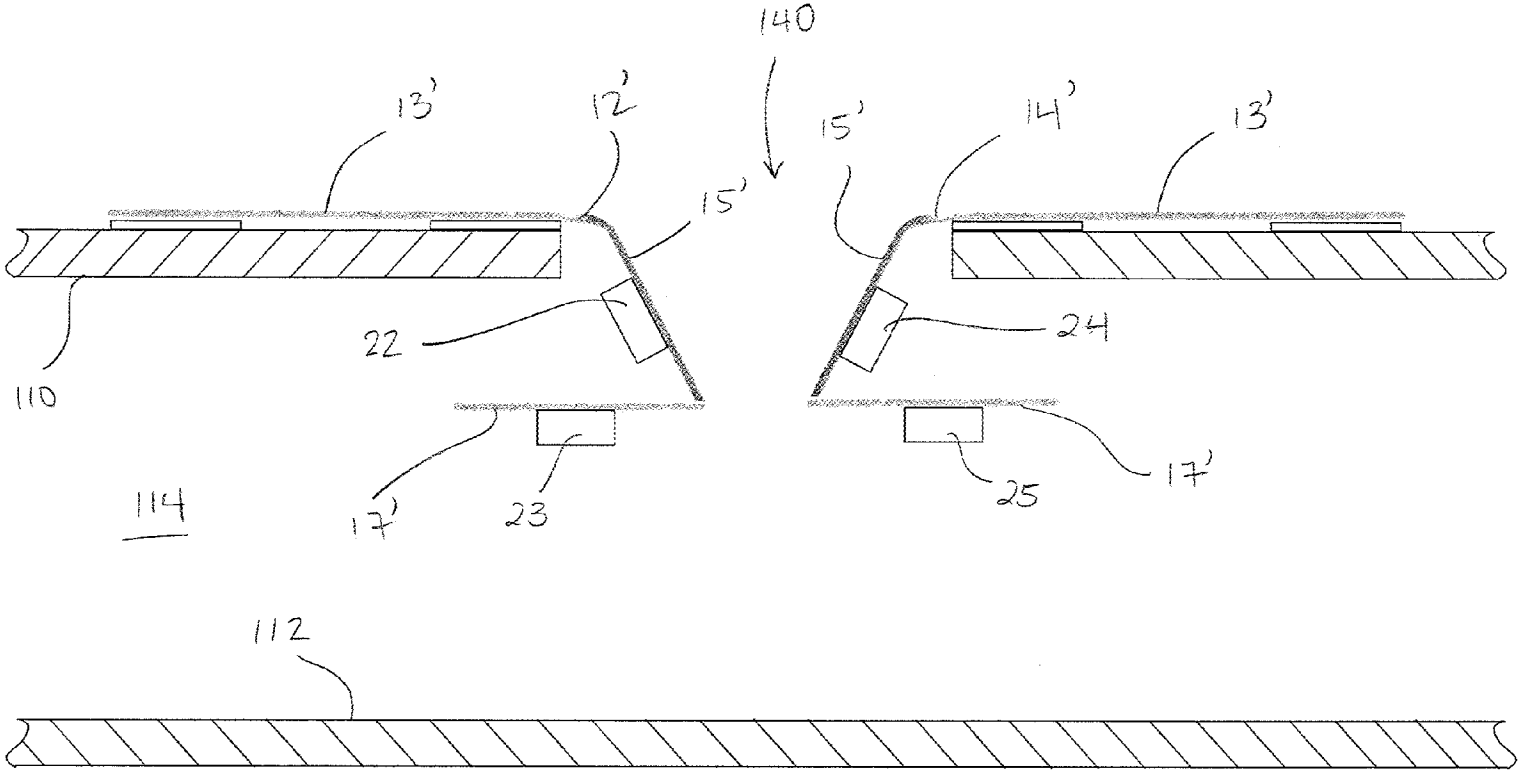
FIG. 6 is a schematic of an instrument cross-section using the plate of FIG. 5.

In some embodiments, the plate may have two bends. In some cases, the first bend may allow the plate to dip down into the hollow body of the instrument through the sound hole, and the second bend may allow the remaining section of the plate to extend through the hollow body of the instrument. For example, an illustrative embodiment is shown in FIG. 5, where a plate 12' has a first bend at an angle θ1 and a second bend at an angle θ2. The plate 12' has a first section 13', second section 15', and third section 17'. In some embodiments, the two angles θ1 and θ2 are supplementary angles such that the first section 13' of the plate and the third section of the plate 17' run parallel to one another. As seen in FIG. 6, where the plate of FIG. 5 is attached to an instrument, the second bend of the plate 12' allows the third section 17' of the plate 12' to extend through the space 114 inside the hollow body of the instrument. Plate 14' is also shown with two bends and a third section 17'. The third section of each plate may provide room for attachment of additional transducers. A third transducer 23 is attached to the third section of plate 12' and a fourth transducer 25 is attached to the third section of plate 14'.

It should be appreciated that the angle of the second bend need not be supplementary with the angle of the first bend, and, as a result, the first and third sections need not be parallel to one another.

Using the plate 12 shown in FIG. 2 as an illustrative example, a portion of the first section 13 is attached to the instrument 100 (as seen in FIG. 1), and the second section 15 is angled inwardly into the sound hole of the instrument. In other embodiments, the plate is flat.

It should be appreciated that the plate need not extend at least partially across a sound hole of the instrument. In some embodiments, the plate is adjacent to, or spaced from, the sound hole.

In some embodiments, the plate is made of a material that has a greater density than that of the body of the instrument. In some embodiments, the plate may be made of aluminum, steel, including galvanized steel, or any other suitable metal or metal alloy. In other embodiments, the plate may be made of plastic such as poly(methyl methacrylate) or other polymer, or any other suitable material. The plate may be integrally formed as a single monolithic component. In some embodiments, the plate has a uniform modulus of elasticity throughout. Where a plate is used as or as part of an isolation component, the plate may have a thickness T as shown in FIG. 3. In some embodiments, the thickness may be uniform throughout the entire plate. In one embodiment, if the plate has a protruding portion, the protruding portion may have a thickness that is the same as that of the first section. In other embodiments, the plate may have portions with different thicknesses. For example, if the plate has a second section, the second section may have a thickness that is different than that of the first section. In some embodiments, the thickness of the plate is 0.03 to 0.055 inches. In one embodiment, the plate has a thickness of 1/32 inches.

In accordance with one aspect, the instrument trigger system is a kit that can be installed onto an instrument by a user at home or by a professional such as a luthier. The instrument trigger system may be used with a wide variety of instruments and models. The inventors have appreciated that providing a kit may allow users to enhance the instruments they already own and are accustomed to, rather than requiring the user to purchase an entirely new instrument in order to use the instrument trigger system. In other aspects, however, the instrument trigger system is integrated with an instrument at the manufacturing stage such that the instrument has a built-in instrument trigger system.

In one illustrative embodiment shown in FIG. 1, the instrument trigger system is a wired system. In this embodiment, cables are run through the inside of the instrument. As seen in FIG. 1, a first cable 32 is attached to the first transducer 22 and a second cable 34 is attached to the second transducer 24. The cables 32, 34 are run through the inside of the body 110 of the instrument 100 and to an output jack 50. In some embodiments, a hole is drilled through the instrument to accommodate the output jack. Such an arrangement may be installed by attaching the transducers to the plates, attaching the plates to the instrument (e.g. with intervening foam or foam tape between the plates and the instrument), and fishing the transducer cables into the instrument through the sound hole, through the inside of the instrument body, and out through the hole drilled for the output jack. The transducer cables are then connected to the output jack and the output jack is installed to the instrument.

In some cases, to prevent movement of the cables 32, 34 inside the body of the instrument, the cables may be mounted to a carrier 40, which holds the cables against an interior surface inside the instrument body 110. The carrier is positioned inside the instrument and hidden from view. The carrier may be made of foam or other suitable material and may be attached to the interior surface of the instrument via adhesive, mechanical attachment, hook-and-loop-type fasteners, or via any other suitable arrangement.

In some embodiments, the cables 32, 34 may each be composed of two or more cables connected together. For example, in FIG. 1, cables 32, 34 are each composed of two cables. The cables further from the transducers include male jacks 42, 44. Such an arrangement may provide for easier maintenance or repair, as the plates and transducers can be removed from the instrument by disconnecting the cables at the male jack connection points, rather than needing to remove the output jack 50 from the instrument. The plates can then be reattached to the instrument and the transducers reconnected to the output jack by connecting the transducer cables with the male jacks 42, 44. In other embodiments, however, the cables 32, 34 are each a single cable without a disconnection point along the length of the cable.

The output jack 50 may connect to a signal receiving device 230, which may be a sound module, a looping machine, a visual display such as a light display or screen, or any other suitable device. In some embodiments, the signal receiving device 230 further connects to one or more devices 240, such as a mixer, amplifier, or a combined mixer-amplifier.

The transducers 22, 24 may be attached to the plates 12, 14 via adhesive such as tape or glue, hook and loop-type fasteners, mechanical attachment, etc. In one embodiment, the transducers 22, 24 are attached to the plates via double-sided tape. The transducers may be pre-attached to the plates or may be attached to the plates by a user at home or by a professional such as a luthier.

Figure 7:
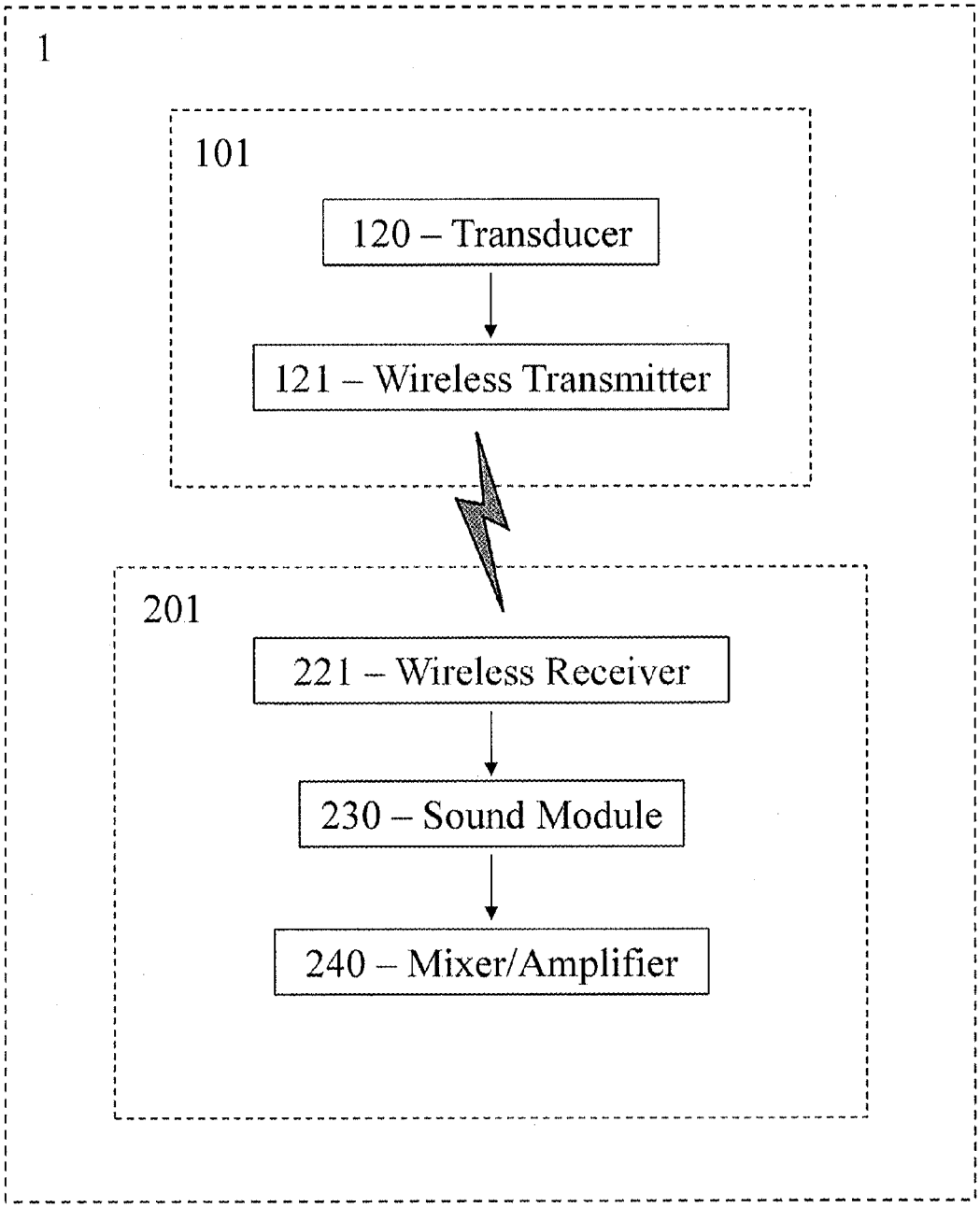
FIG. 7 is a schematic of an instrument trigger system using a wireless transmission arrangement according to one embodiment.

In some embodiments, electrical signals from the transducer are wirelessly transmitted. The electrical signals may be wirelessly transmitted to a signal receiving device such as a sound module. The inventors have appreciated that a wireless transmission arrangement may allow the instrument trigger system to be more easily installed onto an instrument. In some wireless transmission embodiments, cables need not be run through the body of the instrument, and a hole need not be drilled through the body of the instrument. In one illustrative embodiment shown in FIG. 7, an instrument trigger system 1 includes an instrument portion 101 and an action portion 201. The instrument portion 101 of the system 1 includes a transducer 120 and a wireless transmitter 121. The transducer 120 and wireless transmitter 121 may both be physically attached to the instrument. The transducer 120 may be physically attached to the instrument via an isolation component as previously described. The wireless transmitter 121 may be directly or indirectly physically attached to the transducer 120. In some embodiments, the wireless transmitter 121 is directly attached to the isolation component to which the transducer 120 is attached. The action portion 201 of the system 1 includes a wireless receiver 221 which wirelessly receives electrical signals from the wireless transmitter 121. The wireless receiver 221 may then relay such electrical signals to a suitable signal receiving device, such as a sound module 230. The sound module may then transmit information to a mixer/amplifier 240. As discussed previously, electrical signals from the transducer may be sent to different devices other than or in addition to a sound module, such as a looping machine or visual display.

The above aspects and embodiments may be employed in any suitable combination, as the present invention is not limited in this respect.

It should also be understood that, unless clearly indicated to the contrary, in any methods claimed herein that include more than one step or act, the order of the steps or acts of the method is not necessarily limited to the order in which the steps or acts of the method are recited.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A trigger system, the system comprising:

an acoustic guitar comprising strings and a hollow body having a sound board;

a first plate attached to the sound board; and a first transducer attached to the first plate, the first transducer configured to output an electrical signal in response to physical vibration of the first plate due to striking of the first plate, wherein plucking of the strings fails to actuate the first transducer.

2. The trigger system of claim 1, further comprising a signal receiving device, wherein the first transducer is configured to output an electrical signal to the signal receiving device in response to physical vibration of the first plate.

3. The trigger system of claim 2, wherein the signal receiving device comprises a sound module.

4. The trigger system of claim 3, wherein the sound module comprises a drum module.

5. The trigger system of claim 2, wherein electrical signals from the first transducer are wirelessly transmitted to the signal receiving device.

6. The trigger system of claim 1, wherein the first plate is made of a metal.

7. The trigger system of claim 6, wherein the metal comprises galvanized steel.

8. The trigger system of claim 1, wherein the acoustic guitar further comprises a sound hole.

9. The trigger system of claim 8, wherein the first plate is located within four inches of the sound hole.

10. The trigger system of claim 9, wherein the first plate is adjacent to the sound hole.

11. The trigger system of claim 9, wherein at least a portion of the first plate extends partially across the sound hole.

12. The trigger system of claim 11, wherein the portion of the first plate extends into the sound hole.

13. The trigger system of claim 8, further comprising a vibration absorbing material, wherein the first plate is attached to the sound board via an intervening vibration absorbing material such that the first plate is indirectly attached to the sound board.

14. The trigger system of claim 13, wherein the vibration absorbing material comprises foam.

15. The trigger system of claim 1, wherein the plate is bent at an angle of 80° to 130°.

16. The trigger system of claim 15, wherein the plate is bent at an angle of 110° to 120°.

17. The trigger system of claim 1, further comprising:

a second plate attached to the sound board;

a second transducer attached to the second plate, the second transducer being configured to output an electrical signal in response to physical vibration of the second plate, wherein striking the first plate actuates the first transducer to output a signal and fails to actuate the second transducer.

18. The trigger system of claim 1, wherein the acoustic guitar further comprises a sound hole, a bridge and a fingerboard, wherein the first plate is attached to the string instrument and the first plate is located within four inches of a region of the acoustic guitar between the bridge and a lower portion of the fingerboard.

19. The trigger system of claim 1, wherein the first plate includes a first section and a second section extending from the first section, and wherein the second section comprises a tongue such that a width of the second section is less than a width of the first section.

20. The trigger system of claim 1, further comprising a vibration absorbing material attached to the first plate, the vibration absorbing material being attached to the sound board.

21. The trigger system of claim 1, wherein the first plate is made of a plastic.

22. A trigger system, the system comprising:

an acoustic guitar comprising strings;

a first plate attached to the acoustic guitar;

a second plate attached to the acoustic guitar;

a sound module; and a first transducer attached to the first plate, the first transducer configured to output a first electrical signal to the sound module in response to physical vibration of the first plate, a second transducer attached to the second plate, the second transducer configured to output a second electrical signal to the sound module in response to physical vibration of the second plate, wherein:

plucking of the strings fails to actuate the first transducer and fails to actuate the second transducer, striking of the first plate fails to actuate the second transducer, and striking of the second plate fails to actuate the first transducer.

23. The trigger system of claim 22, further comprising a vibration absorbing material, the vibration absorbing material being attached to the acoustic guitar and to the first plate.

24. A method of using a trigger system for a string instrument, comprising:

providing an acoustic guitar comprising a hollow body having a sound board;

providing a first transducer that is attached to a first plate, the first plate being attached to the sound board; and striking the first plate to vibrate the first plate, wherein the striking of the first plate actuates the first transducer to output an electrical signal.

25. The method of claim 24, further comprising:

providing a second transducer that is attached to a second plate, the second plate being attached to the sound board, wherein the striking of the first plate actuates the first transducer to output an electrical signal and fails to actuate the second transducer.

26. The method of claim 25, further comprising:

striking the second plate to vibrate the second plate, wherein the striking of the second plate actuates the second transducer to output an electrical signal and fails to actuate the first transducer.

27. The method of claim 24, wherein striking the first plate comprises striking the first plate directly by hand.

28. The method of claim 24, further comprising:

providing a signal receiving device, wherein the first transducer is constructed and arranged to output an electrical signal to the signal receiving device in response to physical vibration of the first plate.

* * * * *